US006045212A

United States Patent [19]

Ruhe et al.

[11] Patent Number: 6,045,212

[45] Date of Patent: Apr. 4, 2000

[54] INTEGRAL SPRING DRIVE BELT SYSTEM FOR INKJET CARRIAGES

[75] Inventors: Thomas W. Ruhe, LaCenter; Brently L. Cooper, Brush Prairie, both of Wash.

[73] Assignee: Hewlett-Packard Company, Palo Alto, Calif.

[21] Appl. No.: 09/126,988

[22] Filed: Jul. 30, 1998

[51] Int. Cl.[7] ..... B41J 23/00

[52] U.S. Cl. ..... 347/37; 347/37; 346/139 A; 400/320

[58] Field of Search ..... 347/37, 38; 246/193 A, 246/193 B, 193 D; 400/320, 323

[56] References Cited

U.S. PATENT DOCUMENTS

| | | | |
|---|---|---|---|
| 4,875,634 | 10/1989 | Lapadakis | 242/67.3 R |
| 5,036,266 | 7/1991 | Burke | 400/322 |
| 5,200,767 | 4/1993 | Tsukada et al. | 346/139 A |
| 5,465,107 | 11/1995 | Mayo et al. | 346/139 B |
| 5,871,085 | 2/1999 | Yagi | 198/835 |
| 5,964,542 | 10/1999 | Rhue et al. | 400/352 |
| 5,966,147 | 10/1999 | Matsui | 347/37 |

*Primary Examiner*—N. Le
*Assistant Examiner*—Hean Yuth
*Attorney, Agent, or Firm*—Flory L. Martin

[57] ABSTRACT

A rising rate integral spring drive belt system for driving a carriage carrying an inkjet printhead is quieter and more economical than earlier systems. An integral spring drive belt of a resilient material is secured to the carriage and driven by a motor to selectively move the carriage across the printzone. The belt is of a resilient elastomeric material. The belt has an integral spring portion with two segmented members defining a void therebetween and a web member coupling together the two segmented members. The remainder of the belt has a constant spring constant, while the spring portion has a higher spring constant which varies with the degree of tension experienced by the belt. The variable spring constant allows the spring portion to more readily respond to and damp periodic belt tension vibrations to provide a quieter, more economical printing mechanism. A method is provided driving an inkjet printhead carriage.

20 Claims, 4 Drawing Sheets

INTEGRAL SPRING DRIVE BELT SYSTEM FOR INKJET CARRIAGES

FIELD OF THE INVENTION

The present invention relates generally to inkjet printing mechanisms, and more particularly to a rising rate integral spring drive belt system for driving a carriage carrying an inkjet printhead that is quieter and more economical than earlier systems.

BACKGROUND OF THE INVENTION

Inkjet printing mechanisms use inkjet cartridges, often called "pens," which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. Some caps are also designed to facilitate priming, such as by being connected to a pumping unit or other mechanism that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the face of the printhead.

In the past, the inkjet printhead was carried back and forth across the page in a carriage attached to a belt that was driven by a drive pulley and carriage drive motor. Typically, the drive pulley was located at one end of the printzone, and an idler or tensioning pulley was located at the opposite end of the printzone. Several different belt and drive pulley systems have been used. One the more popular systems employs a toothed belt, similar to a timing belt in automobiles, which is driven by a pulley having mating teeth formed in the pulley's drive surface. The pulley teeth engage the belt teeth to provide a very reliable system that never slips. This tooth arrangement has a high tension ratio across the drive pulley, which yields a low belt tension requirement.

The term belt tension refers to the static axial load or nominal tension in the belt to which the belt is stretched before use. Low belt tensions are preferred because higher belt tensions yield increased friction, higher motor heat, and wear. Moreover, with lower belt tensions both the motor and belt-tensioning pulley may be constructed without ball bearings, which reduces the overall system cost. Often, separate spring-biased, belt tensioning devices were used to provide a desired static belt tension, while also removing undesirable slack in the belt. Unfortunately, these belt tensioners increased the overall cost of the printing mechanism, not only in terms of additional component costs, but also in labor costs for assembly.

In general, the toothed belt drives have some inherent disadvantages. For example, the teeth do not transmit power smoothly when driving the carriage because the engagement and disengagement of the teeth produces a non-uniform driving force. Additionally, the belt tooth passing vibration occurs at frequencies that induce undesirable carriage velocity ripple. Moreover, these tooth engagement disturbances excited numerous noise sources within the printer, due to resonance which was concentrated in narrow frequency bands. Thus, printers using a toothed belt carriage drive system were perceived as being noisy, and a source of annoyance to consumers. Unfortunately, the belt tensioning devices mentioned above were unable to dynamically respond to these high frequency, rapid vibrations to provide adequate damping of this noise source.

To achieve accurate printing it is important to know or maintain an accurate positional relationship between the carriage and the media, with the printhead carriage moving smoothly across the media with minimum vibration to accurately locate each ink droplet of the image. As the number of dots per inch increases, the dot size has decreased, increasing the dot density to yield higher quality images, particularly in photographic images. One challenge in striving to achieve such improved image quality is the adverse impact of carriage vibrations. Consider now a situation where the carriage vibrates during printing over an entire image, the effect appears as a banding of lighter and darker areas of the image. Given the same vibration amplitude, the impact to an image formed of smaller dots is more adverse than to an image formed with the larger dots. In general, the smaller dot size and higher resolution of advancing ink jet printers require more accurate placement of dots to achieve expected image quality improvements. Any vibrations displacing the carriage relative to the media can potentially reduce printing accuracy. Typical sources of vibration are external vibrations which move the whole printer or scanner, and internal sources which stem from items coupled to the carriage, such as the carriage drive belt.

Another earlier carriage drive system employs a V-shaped belt driven by a pulley having a V-shaped groove around its periphery. While the V-belt drive systems exhibit improved acoustic properties and more consistent driving forces, unfortunately they have significant drawbacks. For instance, the V-belt drive system is susceptible to slipping when oil or other lubricants inadvertently contact the belt. The V-belts are inherently thick, and must be wrapped around a large diameter pulley, which made it necessary to use larger motor, since the pulley diameter could not be chosen to optimize motor performance. Moreover, the larger diameter pulley also increases the internal space required for the V-belt drive system within the printer. Another disadvantage of the V-belt drive is the low tension ratio across the drive pulley, which unfortunately induces high belt tension, leaving the belts susceptible to premature breakage. Thus, reliability of the V-belt drive systems is questionable. This high belt tension also increases friction in the V-belt system unless expensive ball bearings are used on the rotating components.

Another carriage drive system that has been proposed is a smooth belt which runs on a smooth pulley. Unfortunately, the smooth belt system is severely limited in the amount of power which it can transmit. In other words, as the driven load increases, for instance due to larger inkjet cartridges carrying greater supplies of ink, the smooth belts slip on the smooth pulleys. And, of course, this slippage increases if the smooth belt system is exposed to oil or other lubricating contaminants. Another system that has been proposed uses a smooth belt driven by a pulley having a drive surface coated with a grit material or having a knurled drive surface.

Thus, there exists a need for an inkjet carriage drive belt system which removes undesirable periodic belt tension vibration, and which may also eliminate the need for separate belt tensioning and slack removal devices, while providing an accurate, reliable carriage drive.

SUMMARY OF THE INVENTION

According to one aspect of the present invention, an integral spring drive belt system is provided for driving a carriage that moves an inkjet printhead across a printzone in an inkjet printing mechanism. The integral spring drive belt system includes a carriage drive motor having an output shaft and a drive member coupled to the motor output shaft. An integral spring drive belt of a resilient material is secured to the carriage and engaged by the drive member to selectively move the carriage across the printzone. The belt has an integral spring portion constructed from the resilient belt material. This integral spring portion has two segmented members defining a void between them, and a web member coupling together the two segmented members.

According to a further aspect of the invention, an inkjet printing mechanism is provided with an integral spring drive belt system as described above.

According to another aspect of the invention, a method is provided for moving a printhead carriage across a printzone in an inkjet printing mechanism. The method includes the step of driving the printhead carriage across the printzone with a belt coupled to the carriage, wherein the belt has a spring portion with a spring constant which varies with the amount of tension applied to the belt. The method includes the step of, during the driving step, inducing tension vibrations in the belt. In a dampening step, the periodic belt tension vibrations are damped with the spring portion of the belt.

An overall goal of the present invention is to provide an inkjet printing mechanism which reliably produces clear crisp images while smoothly moving the inkjet printhead across a printzone during printing.

A further goal of the present invention is to provide a method of quieting the printhead carriage motion to provide an inkjet printing mechanism which operates quieter than its predecessors.

DETAILED DESCRIPTION OF THE PREFERRED EMBODIMENTS

Figure 1:
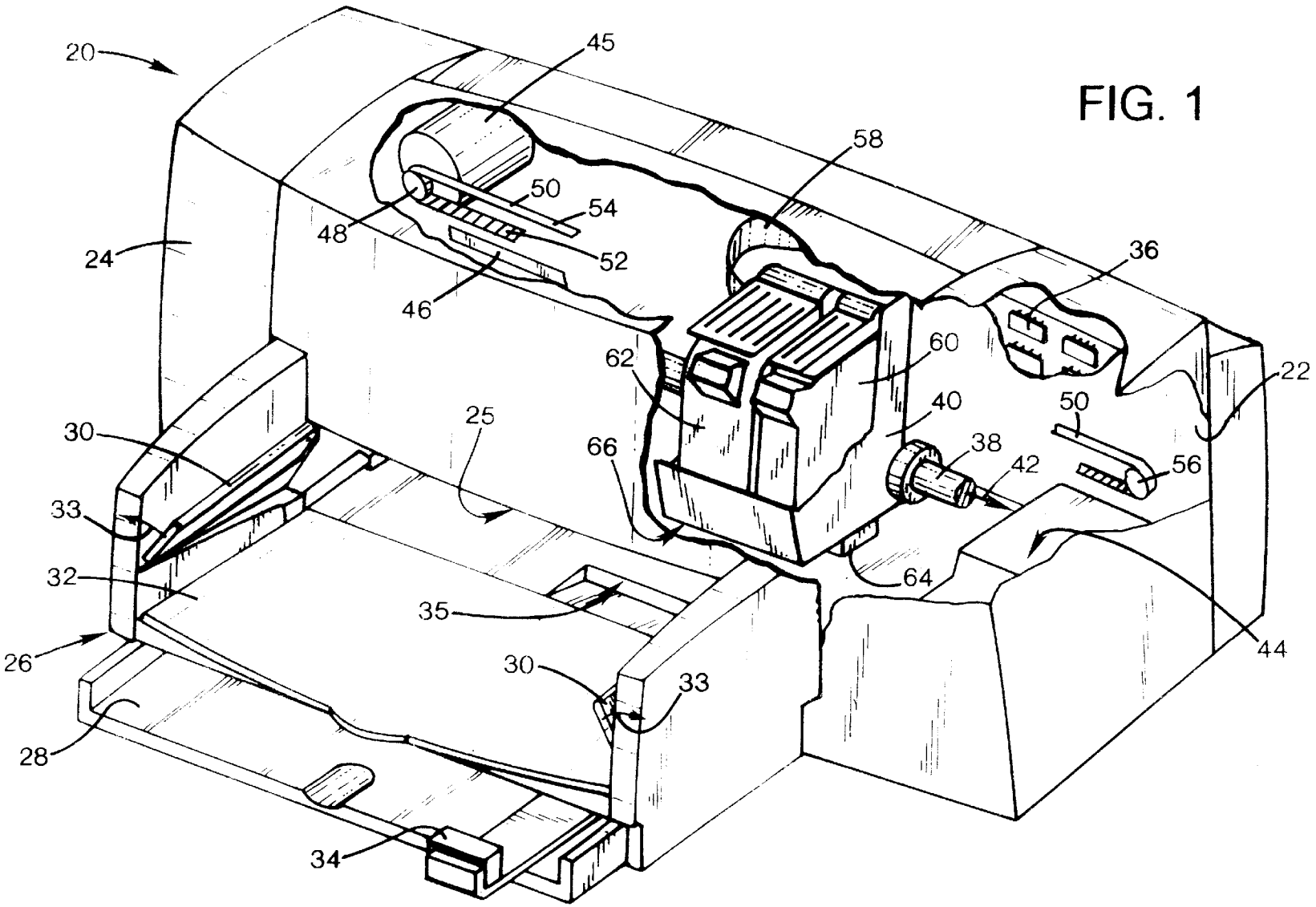
FIG. 1 is a fragmented, partially schematic, perspective view of one form of an inkjet printing mechanism employing one form of an integral spring drive belt system of the present invention, including a rising rate integral spring drive belt or spring belt, for propelling an inkjet printhead across a printzone for printing.
Figure 2:
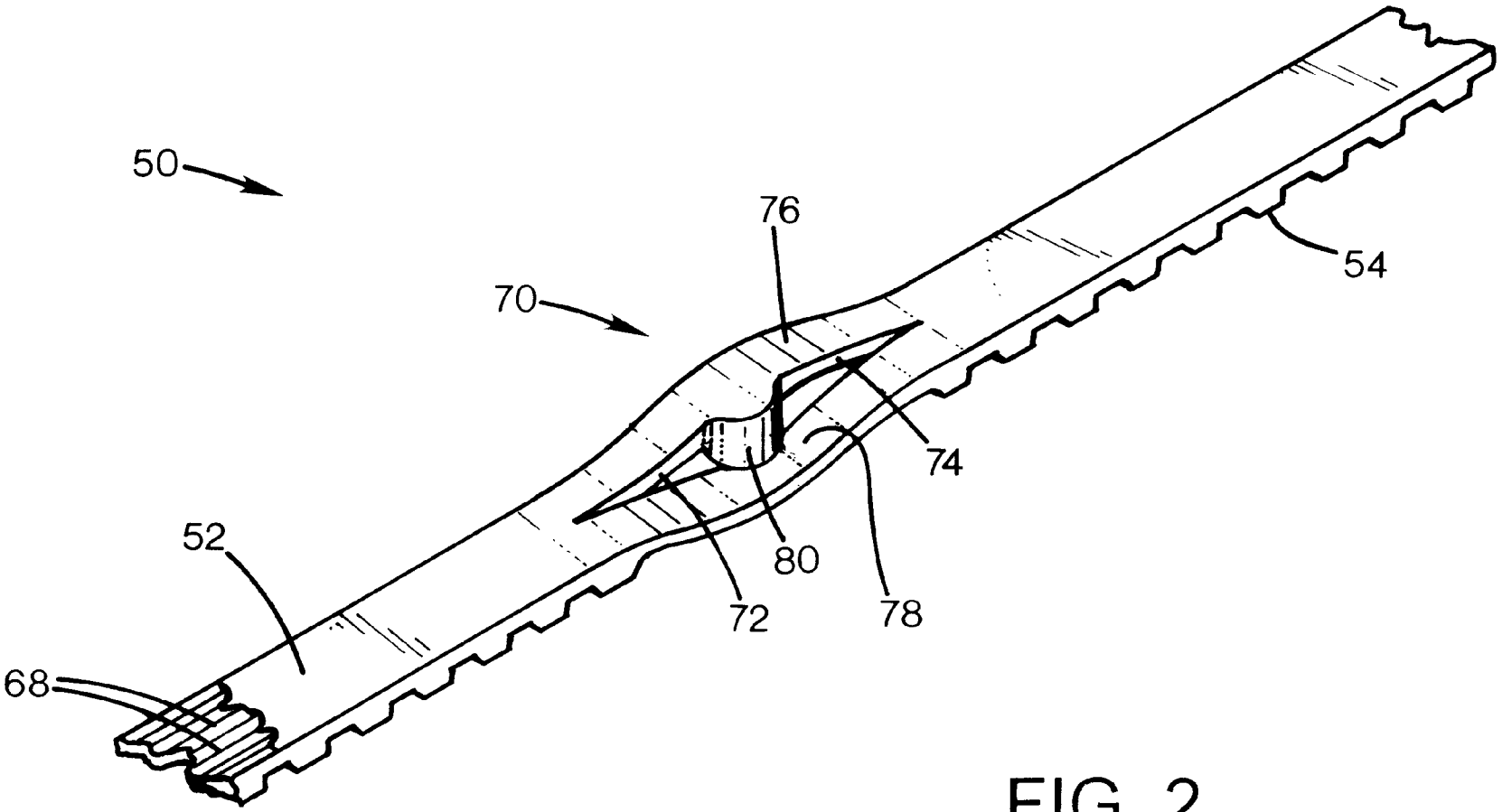
FIG. 2 is an enlarged perspective view of a portion of the spring belt of FIG. 1.
Figure 3:
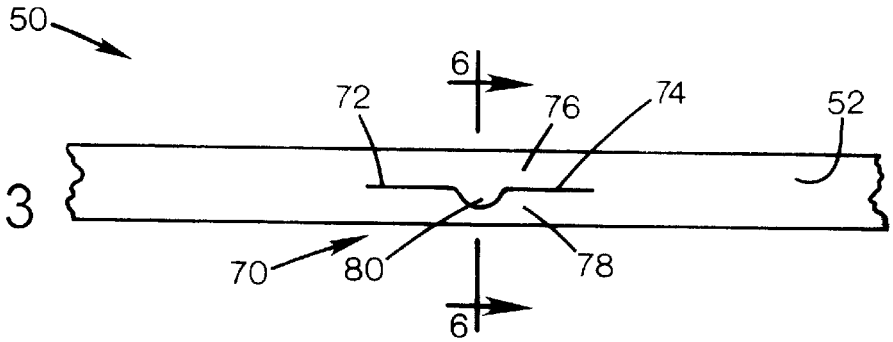
FIG. 3 is an enlarged top plan view of the portion of the spring belt shown in FIG. 2.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by a print media handling system 26. The print media may be any type of suitable sheet material, such as paper, card-stock, fabric, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing, and then onto a pair of retractable output drying wing members 30. The wings 30 momentarily hold the newly printed sheet above any previously printed sheets still drying in an output tray portion 32, after which the wings 30 retract to the sides, as shown by arrows 33, to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and a sliding envelope feed slot 35.

The printer 20 also has a printer controller, illustrated schematically as a microprocessor 36, that receives instructions from a host device, typically a computer, such as a personal computer (not shown). The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an inkjet carriage 40 for travel back and forth, reciprocally, across the printzone 25 along a scanning axis 42. One suitable type of carriage support system is shown in U.S. Pat. No. 5,366,305, assigned to Hewlett-Packard Company, the assignee of the present invention. The carriage 40 is also propelled along guide rod 38 into a servicing region 44 housing a service station, which may be any type of servicing device, sized to service the particular printing cartridges used in a particular implementation. Service stations, such as those used in commercially available printers, typically include wiping, capping and often priming devices, as well as a spittoon portion, as described above in the Background Section above. One suitable preferred service station is commercially available in the DeskJet® 720C and 722C color inkjet printers, produced by the present assignee, Hewlett-Packard Company, of Palo Alto, Calif.

Several components are coupled to the printhead carriage 40. First, the printer 20 has a DC carriage drive motor 45, which may be coupled in a conventional manner to the pen carriage 40 to incrementally advance the carriage along the guide rod 38. The motor 45 operates in response to control signals received from the printer controller 36. To provide carriage positional feedback information to printer controller 36, an encoder strip 46 extends along the length of the printzone 25 and over the service station region 44. Another component coupled to the carriage 40 may be a conventional optical encoder reader (not shown), mounted along the rear surface of the carriage 40 to read positional information provided by the encoder strip 46. The manner of providing positional feedback information via the encoder strip reader, may be accomplished in a variety of different ways known to those skilled in the art.

The motor 45 drives a toothed drive pulley 48 that together form a portion of an integral spring drive belt system, including a rising rate integral spring drive belt or spring belt 50, constructed in accordance with the present invention as described in further detail below with respect to FIGS. 2–8. The illustrated embodiment of the spring belt 50 has an exterior surface 52 and a toothed interior surface 54 which is engaged by mating teeth formed on the drive pulley 48. The toothed interior surface 54 engaged by the toothed pulley 48 to drive the spring belt 50 around an idler pulley 56, which is supported by the chassis 22. The spring belt 50 may be secured to the pen carriage 40 in a conventional or other manner, as known to those skilled in the art. Indeed, the spring belt 50 may be a continuous endless belt, or it may be a strip having both ends attached to the carriage, but a continuous belt is preferred to provide more consistent performance from printer to printer when constructing many printers 20 in a mass-manufacturing facility. Also attached to the carriage 40 is a multi-conductor strip 58 used to deliver firing command control signals from the controller 36 to the printhead carriage 40, and to provide printhead status signals, such as printhead temperature, back to controller 36.

In the printzone 25, a media sheet receives ink from an inkjet cartridge, such as a monochrome black ink cartridge 60 and/or a color ink cartridge 62. The cartridges 60 and 62 are also often called "pens" by those in the art. The illustrated color pen 62 is a tri-compartment, tri-color pen, although in some embodiments, a set of discrete monochrome pens may be used. The illustrated pens 60, 62 each include reservoirs for storing a supply of ink, and printheads 64, 66 respectively, for selectively ejecting the ink. The monochrome black pen 60 has a single reservoir containing black ink, whereas the color pen 62 has three reservoirs for carrying cyan, magenta and yellow inks. While the color pen 62 may contain a pigment based ink, for the purposes of illustration, pen 62 is described as containing three dye based ink colors. The black ink pen 60 is illustrated herein as containing a pigment based ink. It is apparent that other types of inks may also be used in pens 60, 62, such as paraffin based inks, as well as hybrid or composite inks having both dye and pigment characteristics.

Each printhead 64, 66 has an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a substrate layer having a plurality of resistors which are associated with the nozzles. Upon energizing a selected resistor, a bubble of gas is formed to eject a droplet of ink from an associated nozzle and onto the print media in printzone 25. The printhead resistors are selectively energized in response to firing command control signals delivered by a multi-conductor strip 54 from the controller 36 to the printhead carriage 40.

Integral Spring Drive Belt System

Figure 7:
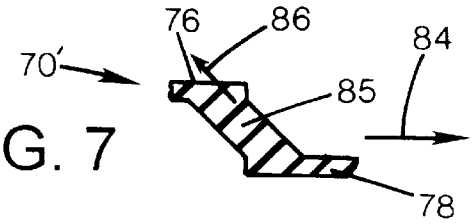
FIG. 7 is a sectional view of an alternative embodiment of the spring member, which may be substituted for the embodiment of FIG. 6.

FIGS. 2–7 show details of the illustrated integral spring drive belt 50, which may be molded of a fiber-reinforced elastomeric material, such as a polyurethane material reinforced with KEVLAR® brand fiber cords 68. Other reinforcing fibers may also be used, such as fiberglass, NOMEX® brand fibers, or polyester fibers. At least one portion of belt 50 has a spring portion 70 where the belt is separated to define two longitudinal slits or voids 72 and 74 that separate the belt 50 into two segments 76 and 78. The belt 50 has a resilient member, such as a spring web 80 that is preferably integrally molded with the other portions of the belt, with the web 80 separating segments 76 and 78. In the illustrated embodiment, segment 78 is biased toward the interior toothed side 54 of the belt and segment 76 is biased outwardly past the belt exterior surface 52. In the embodiment of FIGS. 2–6, the web 80 has a basically cylindrical shape with a longitudinal axis 82 that runs substantially perpendicular to a longitudinal axis 84 of the remainder belt. FIG. 7 shows an alternate embodiment of a spring portion 70' where another resilient member or spring web 85 has a longitudinal axis 86 that runs at a non-right angle with respect to the longitudinal axis 84 of the remainder of the belt.

Figure 5:
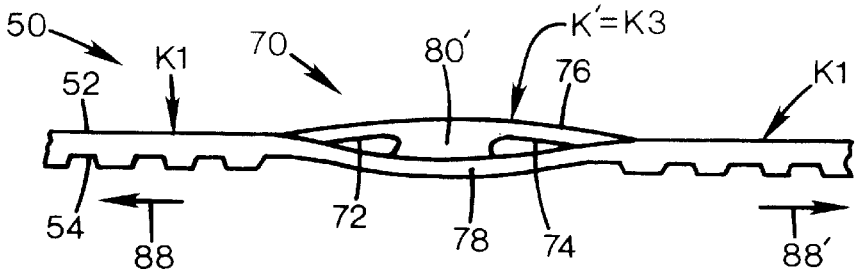
FIG. 5 is an enlarged side elevational view of the portion of the spring belt of FIG. 2, shown with the spring member in a compressed or active state.
Figure 6:
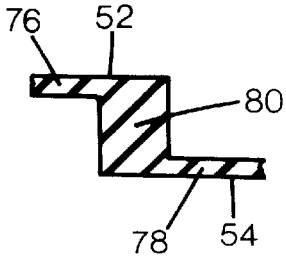
FIG. 6 is a sectional view taken along lines 6—6 of FIG. 3.

FIG. 5 shows the operation of the spring portion 70 when the belt 50 is placed in tension, as indicated by the opposing arrows 88 and 88'. The performance of a resilient body, such as a spring or here, the elastomeric material of the web 80 and the remainder of the belt beyond the spring portion 70, is governed by Hooke's Law:

$$F=KX$$

where:

F=the tension force applied to the belt,

X=the linear deflection of the belt under tension, and

K=the spring constant of the belt.

Figure 4:
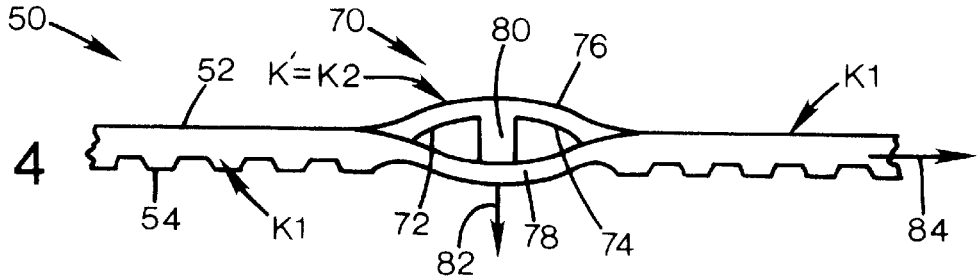
FIG. 4 is an enlarged side elevational view of the portion of the spring belt of FIG. 2, shown with the spring member in an uncompressed or relaxed state.

The remainder of the belt 50, beyond the spring portion 70, has a non-varying spring constant value of K1, while the spring portion 70 has a varying spring constant K', which in the relaxed state of FIG. 4 has a value of K2 (K'=K2). Because of the belt voids or slits 72, 74, and the selected configuration of the spring web 80, the spring portion is fashioned to have a lower spring constant than the remainder of the belt, so K' is less than K1 (K'<K1), resulting in the spring portion 70 stretching faster than the remainder of the belt. Thus, when placed in tension as indicated by the opposing arrows 88 and 88', the spring portion 70 yields and deflects to a greater extent than the remainder of the belt, as illustrated in FIG. 5 where the spring constant of the spring portion has changed to K3. In the loaded view of FIG. 5, the changing shape of the web 80 changes the spring constant of the spring portion 70 from the K2 relaxed state value of FIG. 4 to the loaded value K3, here, increasing the spring constant so K3 is greater than K2 (K3>K2).

The relative cross sectional size and shape of the spring web 80, 85 may be varied, along with the length to vary the performance of the spring portion 70, 70' of the belt 50. For instance, while a relatively cylindrical configuration for the web 80 has been illustrated, other cross sectional shapes may be used, such as oval, rectangular, triangular, hexagonal or other polygonal shapes. Indeed, the cross sectional shape of the web 80 may change between the belt segments 76 and 78, for example, by imparting a conical or hour-glass shape to the spring web. In some implementations it may be preferable to have multiple webs 80 bridging the belt segments 76 and 78, with these multiple webs having either the same or different configurations.

Figure 8:
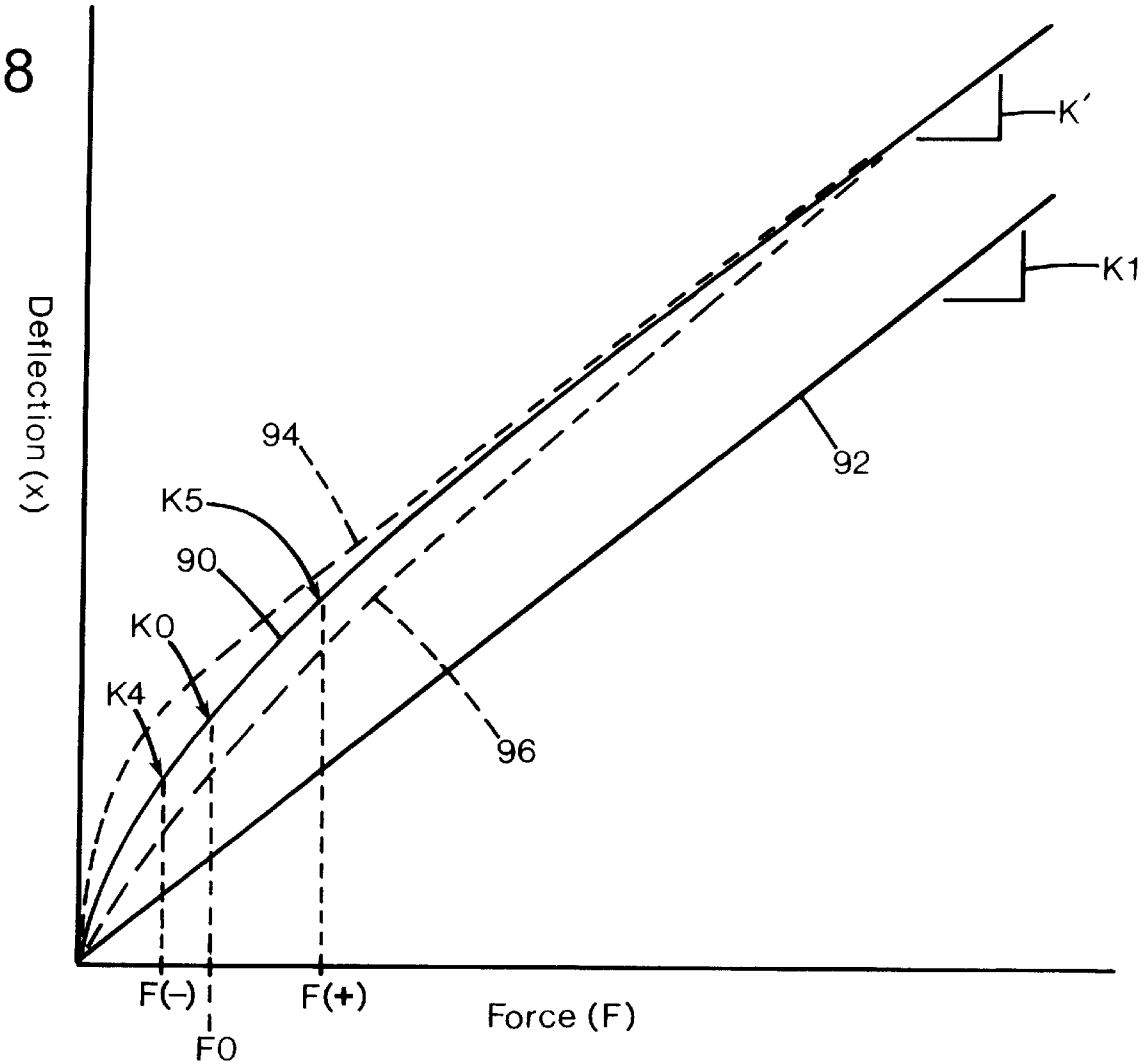
FIG. 8 is a graph the force versus deflection of a conventional belt and of the spring belt of FIG. 2, along with performance variations that may be achieved by modifying the spring belt of FIG. 2, as described further below.

Some of these performance variations that are accomplished by varying the configuration of the spring web 80 are illustrated in the graph of FIG. 8, while other changes may be made through the selection of the material used to construct the belt 50, such as by varying the durometer or relative hardness or stiffness of the belt or the reinforcing fibers 68. The performance of the spring portion 70 is shown by curve 90, with the amount of linear deflection (X) of the spring portion 70 being shown as a function of the tension force (F) applied to the belt 50 (arrows 88 and 88' in FIG. 5). For reference, the performance of a standard belt, which is also equivalent to the performance of the remainder of the belt beyond the spring portion 70, is shown by curve 92. The non-varying nature of the spring constant of the standard belt yields a linear curve 92. In contrast, the changing nature of the geometry of the spring portion 70 as web 80 is compressed yields a varying curve 90 that asymptotically approaches a straight line as the web reaches greater levels of compression. Given the composite geometry of the entire spring belt 50, the total spring constant KT of the belt becomes a function of the varying constant K' of the spring portion 70 at any particular time and the K1 spring constant of the remainder of the belt.

The upper dashed line curve 94 illustrates how the performance of the belt 50 may be varied by making the spring constant K' of the spring portion 70 much smaller than K1 for the remainder of the belt. A belt 50 constructed to have the performance of curve 94 has a greater deflection for a given amount of force than belt 50, with this greater deflection allowing the spring portion 70 to compress faster. The performance of a curve 94 belt may be accomplished by using a smaller cross sectional area for the spring web than shown for web 80, or by shifting to a slanted spring web 85, as shown in FIG. 7. Toward the other end of the spectrum, curve 96 shows the performance of a belt having a spring portion with a varying spring constant K' that is closer in magnitude to the K1 spring constant of the remainder of the belt. Thus, a belt constructed to perform according to curve 96 is stiffer and deflects slower than web 80, which may be accomplished by increasing the relative cross sectional area of the spring web. Another factor that may be used to vary the performance of the belt 50 is to vary the length of slits 72 and 74.

FIG. 8 shows curve 90 the variable spring constant K' increasing from K2 in the relaxed state of FIG. 4 at the origin of the graph where F=0, i.e. no force applied, to a maximum value under increasing forces. Of course, during operation of the printer 20 the spring constant K' fluctuates around a desired operating band as the belt 50 is stretched and then resiliently recovers to the original length. Indeed, rather than installing the belt 50 in a relaxed state, it may be desirable to pre-tension the belt with a small force F0 to establish a nominal spring constant K0, around which the spring constant may dynamically fluctuate, or from which the spring constant may only increase. A fluctuating performance may be desired, where the force drops to a minimum value F(−) to change K' to a value of K4, and increases to a maximum value of F(+) where K' is at a value of K5. The advantage of this pre-tensioning scheme with fluctuation around a nominal spring constant F0 is the ability of the belt 50 to then act as a dampening agent or a mechanical low-pass filter for effectively "soaking-up" undesirable periodic belt tension vibrations induced by the repeated stopping and starting of the carriage 40 as the printheads 60, 62 are incrementally moved across the printzone 25 during printing. Absorbing these undesirable belt tension vibrations allows the printer 20 to operate at a quieter more pleasing noise level than earlier printers, which may be particularly desirable in a home or desktop environment where consumers are in close proximity to printer 20 during printing.

Conclusion

The spring belt may be constructed in a variety of ways know to those skilled in the art, such as by deforming a section of a continuous-cord reinforced belt to divide the section longitudinally with slits 72 and 74 to form belt segments 76 and 78. The divided segments 76, 78 are connected together by the web 80 which may be integrally formed of the same encasing elastomer used to form the remainder of the belt 50. The combined effect of the split segments 76, 78 and the connecting web 80 creates the integrated section of spring portion 70, which has a lower spring rate K' than rate K1 for the remaining unsegmented portion of belt 50. This basic configuration of the spring portion 70 results in a property of increasing spring rate with increasing belt extension, as shown in the graph of FIG. 8.

A variety of advantages are realized by implementing the integral spring drive belt system illustrated herein as including the rising rate integral spring drive belt 50. For instance, the ability of the belt 50 to absorb undesirable periodic belt tension vibrations to provide a quieter printer 20 has been mentioned above. Even more important, is the drastic improvement in print quality as the carriage moves more smoothly across the print media to accurately locate each ink droplet of the image, minimizing the undesirable effects of banding of lighter and darker areas of the image, discussed in the Background section above. Another significant advantage of using the variable compliance of spring belt 50 is that the belt alone may be used to remove slack from the belt by pre-tensioned to a nominal value of F0, as shown in FIG. 8, allowing the printer 20 to be constructed without a costly belt slack removal device, as required by earlier printers. Moreover, the spring portion 70 provides integral belt tension control, eliminating the need for costly separate belt tensioners which were needed in earlier printing mechanisms. Thus, using the integral spring drive belt system illustrated herein advantageously provides consumers with higher print quality in a quieter and more economical printing unit.

We claim:

1. An integral spring drive belt system for driving a carriage that moves an inkjet printhead across a printzone in an inkjet printing mechanism, the integral spring drive belt system comprising:

a carriage drive motor having an output shaft;

a drive member coupled to the motor output shaft; and an integral spring drive belt of a resilient material secured to the carriage and engaged by the drive member to selectively move the carriage across the printzone, with the belt having an integral spring portion of said resilient material comprising two segmented members defining a void therebetween and a web member coupling together the two segmented members.

2. An integral spring drive belt system according to claim 1, wherein the belt has a longitudinal axis, and the void comprises a longitudinal slit substantially parallel with the longitudinal axis of the belt.

3. An integral spring drive belt system according to claim 2, wherein the web member has a cylindrical shape defining a web longitudinal axis which is substantially perpendicular to the longitudinal axis of the belt.

4. An integral spring drive belt system according to claim 1, wherein the belt has a longitudinal axis, and the web member defines a web longitudinal axis which is oriented at a non-right angle to the longitudinal axis of the belt.

5. An integral spring drive belt system according to claim 1, wherein the belt has a longitudinal axis, and the web member defines a web longitudinal axis which is substantially perpendicular to the longitudinal axis of the belt.

6. An integral spring drive belt system according to claim 1, wherein the web member has a substantially constant cross sectional area between the two segmented members.

7. An integral spring drive belt system according to claim 1, wherein:

the drive member comprises a toothed drive pulley; and the belt has an interior surface with a toothed contour configured to engage the toothed drive pulley and be driven thereby.

8. An integral spring drive belt system according to claim 1, wherein:

the belt has an interior surface and an exterior surface; and the web member separates the two segmented members when the belt is in a relaxed state, with one of said two segmented members being biased toward the interior surface of the belt, and the other of said two segmented members being biased toward the exterior surface of the belt.

9. An integral spring drive belt system according to claim 1, wherein:

the drive member comprises a toothed drive pulley;

the belt has an interior surface and an exterior surface, with the interior surface having a toothed contour configured to engage the toothed drive pulley and be driven thereby, with the belt also having a longitudinal axis;

the void comprises a longitudinal slit substantially parallel with the longitudinal axis of the belt;

the web member has a cylindrical shape defining a web longitudinal axis which is substantially perpendicular to the longitudinal axis of the belt;

the web member has a substantially constant cross sectional area between the two segmented members; and the web member separates the two segmented members when the belt is in a relaxed state, with one of said two segmented members being biased toward the interior surface of the belt, and the other of said two segmented members being biased toward the exterior surface of the belt.

10. A method of moving a printhead carriage across a printzone in an inkjet printing mechanism, comprising the steps of:

driving said printhead carriage across the printzone with a belt coupled to the carriage, wherein the belt has a spring portion with a spring constant which varies with the amount of tension applied to the belt;

during said driving step, inducing tension vibrations in the belt; and dampening said periodic belt tension vibrations with said spring portion of the belt.

11. A method according to claim 10, wherein the driving step comprises the belt having another portion with a stable spring constant which is less than the varying spring constant of the spring portion of the belt when the belt is under tension.

12. A method according to claim 10, further including the step of, prior to the driving step, pre-tensioning the belt to a nominal value.

13. A method according to claim 12, wherein the dampening step comprises the step of fluctuating the belt tension around said nominal value.

14. An inkjet printing mechanism, comprising:

a carriage that moves an inkjet printhead across the printzone;

a carriage drive motor having an output shaft;

a drive member coupled to the motor output shaft; and an integral spring drive belt of a resilient materiel secured to the carriage and engaged by the drive member to selectively move the carriage across the printzone, with the belt having an integral spring portion of said resilient material comprising two segmented members defining a void therebetween and a web member coupling together the two segmented members.

15. An inkjet printing mechanism according to claim 14 wherein:

the belt has a longitudinal axis; and the void comprises a longitudinal slit substantially parallel with the longitudinal axis of the belt.

16. An inkjet printing mechanism according to claim 14 wherein:

the belt has a longitudinal axis; and the web member has a cylindrical shape defining a web longitudinal axis which is substantially perpendicular to the longitudinal axis of the belt.

17. An inkjet printing mechanism according to claim 14 wherein the web member has a substantially constant cross sectional area between the two segmented members.

18. An inkjet printing mechanism according to claim 14 wherein:

the belt has an interior surface and an exterior surface; and the web member separates the two segmented members when the belt is in a relaxed state, with one of said two segmented members being biased toward the interior surface of the belt, and the other of said two segmented members being biased toward the exterior surface of the belt.

19. An inkjet printing mechanism according to claim 14 wherein:

the drive member comprises a toothed drive pulley; and the belt has an interior surface and an exterior surface, with the interior surface having a toothed contour configured to engage the toothed drive pulley and be driven thereby, with the belt also having a longitudinal axis.

20. An inkjet printing mechanism according to claim 14 wherein:

the drive member comprises a toothed drive pulley;

the belt has an interior surface and an exterior surface, with the interior surface having a toothed contour configured to engage the toothed drive pulley and be driven thereby, with the belt also having a longitudinal axis;

the void comprises a longitudinal slit substantially parallel with the longitudinal axis of the belt;

the web member has a cylindrical shape defining a web longitudinal axis which is substantially perpendicular to the longitudinal axis of the belt;

the web member has a substantially constant cross sectional area between the two segmented members; and the web member separates the two segmented members when the belt is in a relaxed state, with one of said two segmented members being biased toward the interior surface of the belt, and the other of said two segmented members being biased toward the exterior surface of the belt.

* * * * *